US007354658B2

(12) United States Patent
Sugano et al.

(10) Patent No.: US 7,354,658 B2
(45) Date of Patent: Apr. 8, 2008

(54) OIL SEAL

(75) Inventors: Norio Sugano, Fujisawa (JP); Tsutomu Watanabe, Fukushima (JP); Mitsuo Kakimoto, Fukushima (JP)

(73) Assignee: NOK Corporation, Tokyo (JP)

( * ) Notice: Subject to any disclaimer, the term of this patent is extended or adjusted under 35 U.S.C. 154(b) by 0 days.

(21) Appl. No.: 11/207,750

(22) Filed: Aug. 22, 2005

(65) Prior Publication Data

US 2006/0035104 A1 Feb. 16, 2006

Related U.S. Application Data

(62) Division of application No. 10/181,429, filed as application No. PCT/JP01/00534 on Jan. 26, 2001, now Pat. No. 7,195,800.

(30) Foreign Application Priority Data

Jan. 2, 2000 (JP) ..... 2000-023529
Apr. 2, 2000 (JP) ..... 2000-027129

(51) Int. Cl.
*B32B 15/02* (2006.01)
*B32B 15/04* (2006.01)
*B32B 15/06* (2006.01)

(52) U.S. Cl. ..... 428/612; 428/457; 428/625; 428/626

(58) Field of Classification Search ..... 428/612, 428/625, 626, 687, 457, 220, 332, 465
See application file for complete search history.

(56) References Cited

U.S. PATENT DOCUMENTS 4,019,929 A * 4/1977 Matsudo et al. ..... 428/457

FOREIGN PATENT DOCUMENTS

| | | | |
|---|---|---|---|
| JP | 49-90668 | * | 8/1974 |
| JP | 51-97574 | | 8/1976 |
| JP | 56-139918 | | 10/1981 |
| JP | 2-240460 | | 9/1990 |
| JP | 2-256968 | | 10/1990 |
| JP | 3-27934 | * | 2/1991 |
| JP | 3-114620 | | 5/1991 |
| JP | 3-149465 | | 6/1991 |
| JP | 6-262720 | | 9/1994 |
| JP | 7-117172 | | 5/1995 |
| JP | 9-295306 | | 11/1997 |
| JP | 10-166711 | | 6/1998 |
| JP | 2000-211055 | | 8/2000 |

* cited by examiner

*Primary Examiner*—Michael E. Lavilla
(74) *Attorney, Agent, or Firm*—Jacobson Holman PLLC

(57) ABSTRACT

The present invention provides a metal part in which a rubber is adhered to a portion or the whole of a surface thereof, and a surface treating method of the metal part, in order to improve adhesive property between the metal and the rubber, to easily form a surface roughness in a specific portion of a metal part, and to achieve an improvement of working accuracy in the surface roughness, an improvement of mold maintenance property, a reduction of cost and, man hour. A surface roughness is formed in a portion of a surface of the metal part to which the rubber is adhered, and the surface roughness is transcribed from a mold to the metal part by previously providing with a surface roughness in the mold. A magnitude of the surface roughness is preferably set to be 10 μm or more and less than 60 μm.

2 Claims, 9 Drawing Sheets

(A)

(B)

(C)

OIL SEAL

This is a divisional of application Ser. No. 10/181,429 filed Jul. 25, 2002 now U.S. Pat. No. 7,195,800 which in turn is a nationalization of PCT/JP01/00534 filed Jan. 26, 2001 and published in Japanese.

TECHNICAL FIELD

The present invention relates to a metal part and a surface treating method thereof.

A metal part corresponding to a subject of the present invention is a metal part in which a rubber is adhered to a portion or the whole of a surface, or a metal part worked such that a plurality of metal parts are simultaneously dipped in an adhesive agent solution to apply the adhesive agent solution to a surface of each of the metal parts, and is used, for example, as a supporting part, a mounting part or the like which supports a rubber seal portion in a sealing device such as an oil seal, a gasket or the like.

BACKGROUND ART

In a product such as an oil seal, a gasket or the like in which a rubber is formed on a metal, a sufficient adhesive force can not be obtained between the metal and the rubber by forming the rubber directly on the metal. Accordingly, as shown in FIG. 8, a rubber c is formed on a metal a via an adhesive agent b such as a phenol resin or the like. Further, in the case of directly applying the adhesive agent onto the metal surface, a contact force between the metal and the adhesive agent is weak, and it is impossible to form a good adhesive layer. Then, there is executed a surface treatment for roughening the surface of the metal part before the adhesive agent is applied, in accordance with a zinc phosphate treatment to precipitate a zinc phosphate on the metal surface, a shot blast treatment to form irregularity by hitting the metal surface with hard balls, or the like. That is, in order to form the good adhesive layer, there is executed each of "the zinc phosphate treatment or the shot blast treatment (called as a preliminary treatment)", "an adhesive agent tank dipping", "a swishing-off and drying" and "a baking". As a method of forming the adhesive layer, there is employed a dipping method of directly dipping a plurality of metal parts into the adhesive agent tank in the state of receiving the metal parts in a cage or the like for the reason of nature of the adhesive layer, and the metal parts is swished off together with the cage to prevent a liquid pool from being generated after drawing up the metal parts from the adhesive agent tank, and dried.

However, in the conventional metal part, the metal part and the rubber are not sufficiently adhered and an adhesive failure occurs because of the following reasons.

① An adhesive area (relating to a kind of the adhesive agent (the adhesive force) though) between the metal part and the rubber is insufficient.

② A physical contacting force (an anchor effect) between the adhesive layer and the metal surface (after the preliminary treatment) is insufficient.

③ The adhesive agent flows out from the rubber adhered portion to be insufficient, at a time of swishing off or a forming the rubber.

Further, in the conventional metal part, a certain level (magnitude) of irregularity is applied to the surface of the metal part in accordance with the preliminary treatment (the zinc phosphate treatment or the shot blast treatment) or the like for the purpose of forming the good adhesive film as mentioned above, however, it is impossible to sufficiently obtain an effect of preventing the items ① to ③ mentioned above in this level of irregularity. Further, on the contrary, when the whole of the metal part is largely roughened for the purpose of obtaining an enough effect of preventing the items ① to ③ mentioned above, there occurs a trouble such as a rubber leakage at a time of molding, a size failure in the metal part, a deformation of the metal part or the like, so that this method can not be employed.

Further, the zinc phosphate treatment or the shot blast treatment has been conventionally carried out as mentioned above for the method of roughening the surface of the metal part, however, it is hard to work only a specific part of the metal, and a lot of man hour is required for keeping a working accuracy (roughness) and maintaining the apparatus. Further, since an independent working step is provided, as a matter of course, a working cost and a working time are increased.

Further, in a product such as an oil seal, a gasket or the like in which the rubber is formed on the metal, the adhesive agent is coated on a surface of a metal ring corresponding to the metal part, for the purpose of adhering the metal to the rubber. As the coating method, a dipping method (in which the metal ring is dipped into the adhesive agent solution tank, thereafter dried and baked) is frequently employed due to the film nature of the adhesive agent and a working efficiency, however, when a plurality of metal rings d are simultaneously dipped into an adhesive agent solution e as shown in FIG. 9A, the metal rings d are agglutinated with each other via the adhesive agent solution e as shown in FIG. 9B. Accordingly, when executing the drying and sintering operation in this state, the metal rings d are firmly bonded to each other via an adhesive agent e' as shown in FIG. 9C, and there occurs an bonding failure which is a so-called "two-sheet ring (two sheets of metal rings d are bonded to form one piece)". This bonding failure frequently occurs particularly in the case that the metal ring d is in a thin and flat shape and is small.

A mechanism by which the bonding failure occurs is as follows.

① The metal rings d are gathered in the adhesive agent solution e (refer to FIG. 9A).

② The metal rings d are bonded to each other due to a surface tension of the adhesive agent solution e between the metal rings d overlapping with each other, at a time of drawing up the metal rings d from the adhesive agent solution e (refer to FIG. 9B).

③ The metal rings d are bonded to each other via the adhesive agent e' which is solidified in the following drying and sintering step.

Against the bonding failure, there has been developed an adhesive agent by which the bonding is hard to occur, for the conventional bonding prevention measure, however, a complete countermeasure for all of the products has not been yet carried out due to the product functions.

Accordingly, a "disassembling step" of applying an impact to the metal rings d overlapping with each other so as to separate the metal rings d is added after drawing up the metal rings d from the adhesive agent solution e, and therefore, an extra man hour is required. Further, in this "disassembling step", since a magnitude of the impact which can be applied thereto is limited (it is necessary that a magnitude of the applied impact should not be so large as the metal ring d is deformed), it is a reality that a sufficient effect can not be obtained for the metal ring d which has a thin and flat shape and is small.

The present invention is made by taking the points mentioned above into consideration, and an object of the present invention is to improve an adhesive property between a metal and a rubber, and more particularly to prevent an adhesive failure by adding a roughness (a surface roughness) within a certain level to a metal surface portion on which a rubber is formed, thereby improving an adhesive strength of the portion. Further, another object of the present invention is to make it easy to form a surface roughness on a specific part of the metal part, and to achieve an improvement of working accuracy in the surface roughness, an improvement of mold maintenance property, a reduction of working cost, a reduction of man hour and the like.

Further, another object of the present invention is to prevent an bonding failure (a so-called "two-sheet ring" phenomenon) from occurring in the work that a plurality of metal parts are simultaneously dipped into the adhesive agent solution and the adhesive agent solution is applied to the respective metal parts in the manner mentioned above.

DISCLOSURE OF THE INVENTION

In order to achieve the object mentioned above, in accordance with a first aspect of the present invention, there is provided a metal part comprising:

a surface roughness for increasing an adhesive property between a metal and a rubber, the surface roughness being formed on a portion, to which the rubber is adhered, in a surface of the metal part; and the surface roughness being transcribed from a mold for working the metal part to the metal part at a time of working by previously providing with the surface roughness in the mold. It is preferable that a magnitude of the surface roughness is set to be 10 μm or more and less than 60 μm (a second aspect), and it is particularly preferable that a magnitude of the surface roughness is set to be 10 μm or more and 40 μm or less (a third aspect), in view of a transcribing efficiency, a strength and the like.

Further, in accordance with a fourth aspect of the present invention, there is provided a surface treating method of a metal part to form a surface roughness for increasing an adhesive property between a metal and a rubber on a portion, to which the rubber is adhered, in a surface of the metal part, comprising the steps of:

previously providing a surface roughness in a mold for working the metal part; and transcribing the surface roughness from the mold to the metal part at a time of working. It is preferable that a magnitude of the surface roughness is set to be 10 μm or more and less than 60 μm (a fifth aspect), and it is particularly preferable that a magnitude of the surface roughness is set to be 10 μm or more and 40 μm or less (a sixth aspect), in view of a transcribing efficiency, a strength and the like.

Further, in accordance with a seventh aspect of the present invention, there is provided a surface treating method of a metal part as recited in the fourth aspect mentioned above, wherein recess portions such as a grooves or the like which are deeper than the surface roughness are additionally provided in a roughness applying portion in the mold in which the surface roughness is previously provided.

Further, in accordance with an eighth aspect of the present invention, there is provided a metal part comprising:

a surface roughness being formed on a contact surface of the metal part so that a plurality of metal parts are not bonded to each other at a time of simultaneously dipping the metal parts in an adhesive agent solution so as to apply the adhesive agent solution to the respective metal parts; and the surface roughness being transcribed from a mold for working the metal part to the metal part at a time of working by previously providing with a surface roughness in the mold. It is preferable that a magnitude of the surface roughness transcribed to the contact surface of the metal part is set to be 10 μm or more and less than 60 μm (a ninth aspect), and it is particularly preferable that a magnitude of the surface roughness is set to be 10 μm or more and 40 μm or less (a tenth aspect), in view of a transcribing efficiency, a strength and the like.

Further, in accordance with an eleventh aspect of the present invention, there is provided a surface treating method (an bonding prevention method) of a metal part for simultaneously dipping a plurality of metal parts in an adhesive agent solution and applying the adhesive agent solution to the respective metal parts, without the metal parts being bonded to each other, comprising the steps of:

previously providing a surface roughness in a mold for working the metal part;

transcribing the surface roughness from the mold to the metal part at a time of working the metal part; and dipping the metal part into the adhesive agent solution after transcribing. It is preferable that a magnitude of the surface roughness transcribed into the contact surface of the metal part is set to be 10 μm or more and less than 60 μm (a twelfth aspect), and it is particularly preferable that a magnitude of the surface roughness is set to be 10 μm or more and 40 μm or less (a thirteenth aspect), in view of a transcribing efficiency, a strength and the like.

Principles of improvement of adhesive strength generated by the roughness addition in the metal part or the surface treating method thereof in accordance with the first aspect to the seventh aspect of the present invention provided with the structure mentioned above are as follows.

① An effect of increasing a surface area, that is, an adhesive area generated by an increase of surface roughness.

② An effect of increasing an anchor generated by an increase of surface irregularity due to the increase of surface roughness.

③ An effect of preventing an adhesive agent from flowing but generated by an increase of adhesive agent flow resistance caused by the increase of surface roughness.

Further, since the structure is made such that the surface roughness is transcribed into the rubber forming portion of the metal part by previously providing with the surface roughness in the corresponding portion of the mold to work the metal part, it is possible to make it easy to form the surface roughness in a specific portion of the metal part, and it is possible to achieve an improvement of working accuracy in the surface roughness, an improvement of mold maintenance property, a reduction of working cost, a reduction of man hour, and the like.

Further, on the basis of the metal part or the surface treating method in accordance with the eighth aspect to the thirteenth aspect of the present invention provided with the structure mentioned above, since the contact area between the metal parts is reduced and the bonding possibility due to the adhesive agent is reduced by forming the surface roughness in the contact surface of the metal part, it is possible to prevent a bonding failure in which the metal parts are bonded to each other from occurring.

Further, since the surface roughness is previously provided in the corresponding portion of the mold for working the metal part and the surface roughness is transcribed from the mold to the contact surface of the metal part, it is possible to make it easy to form the surface roughness in a specific portion of the metal part, and further it is possible to achieve an improvement of working accuracy in the surface roughness, an improvement of mold maintenance property, a reduction of working cost, a reduction of man hour and the like.

BEST MODE FOR CARRYING OUT THE INVENTION

Next, a description will be given of embodiments in accordance with the present invention with reference to the accompanying drawings.

FIRST EMBODIMENT

Figure 1:
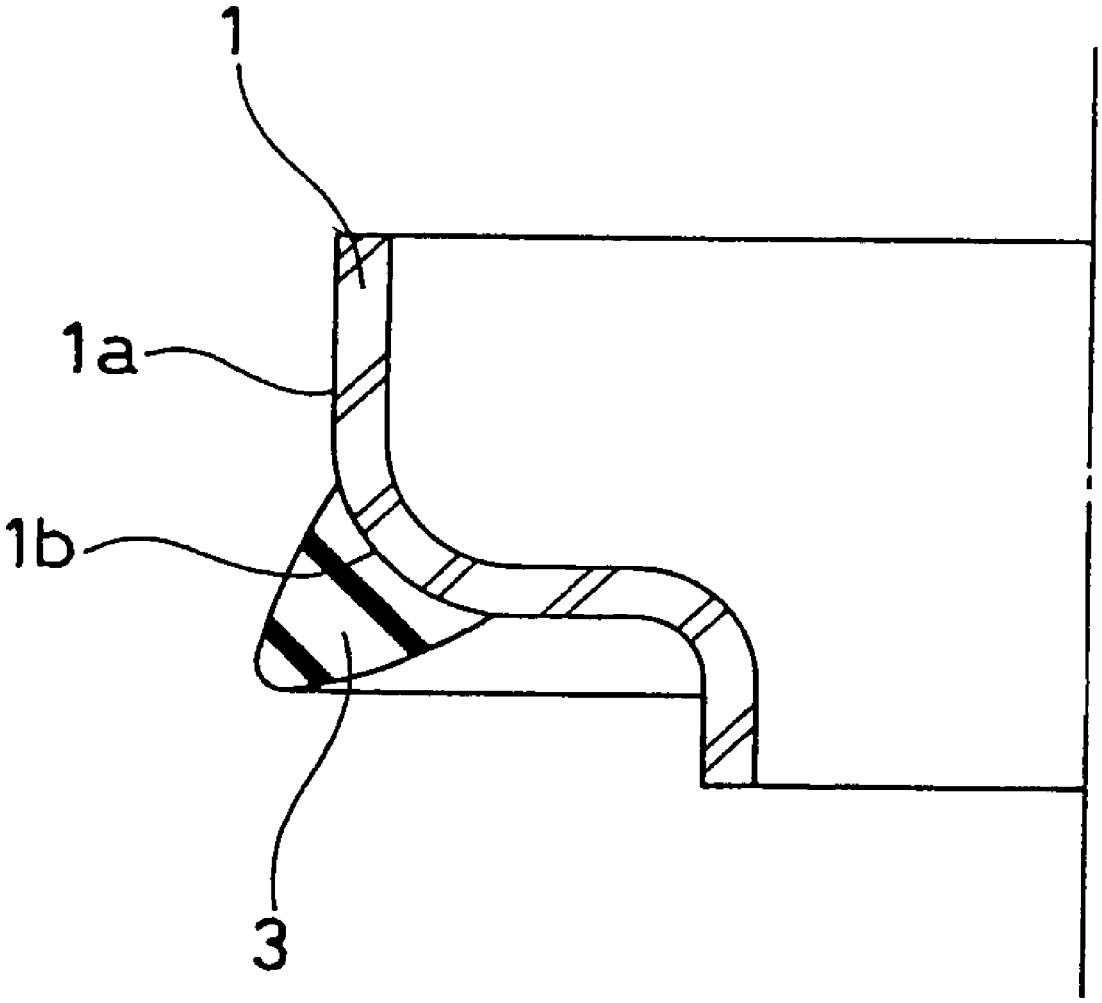
FIG. 1 is a half cut cross sectional view of a product provided with a metal part in accordance with a first embodiment of the present invention.
Figure 2:
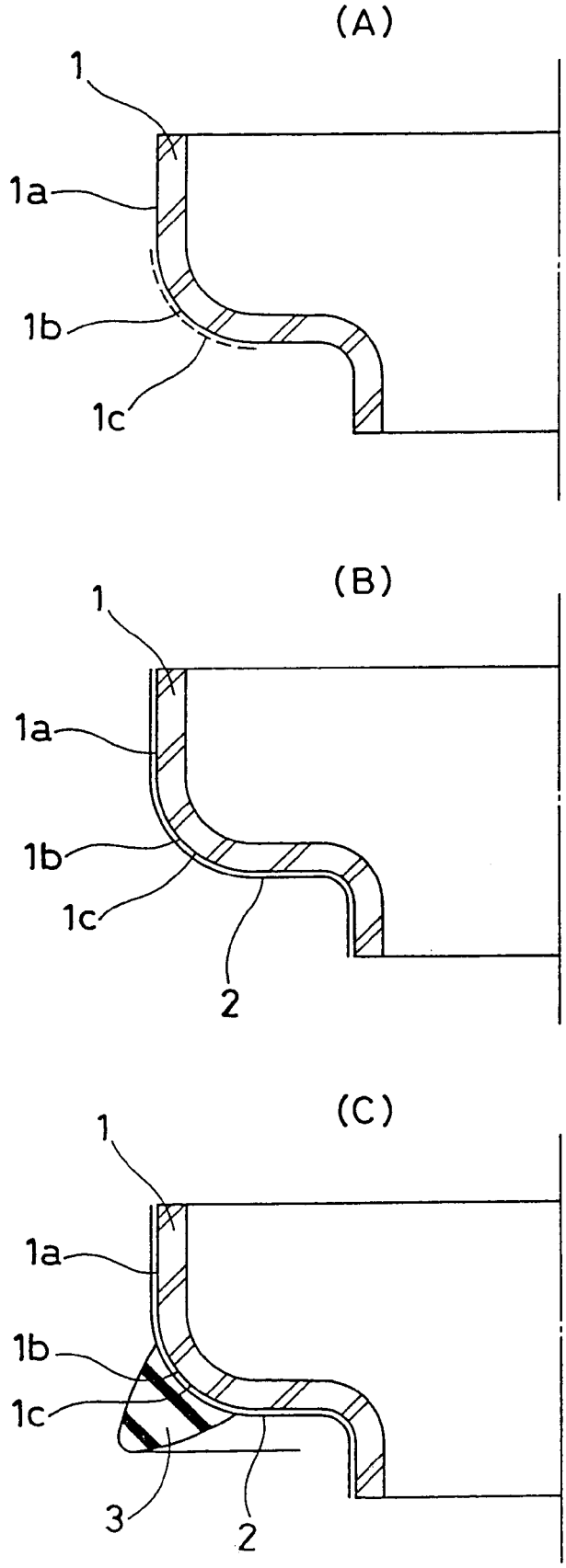
FIGS. 2A, 2B and 2C are schematic views showing manufacturing steps of the product.

FIG. 1 is a half cut cross sectional view of a product such as a sealing apparatus provided with a metal part in accordance with a first embodiment of the present invention, and FIGS. 2A, 2B and 2C are schematic views showing manufacturing steps of the product in this order.

As shown in FIG. 1, a metal part in accordance with the embodiment is constituted of a metal ring 1 formed by punching and pressing a rolled steel corresponding to a raw material, and a surface roughness (also simply called as a roughness, not shown) which is determined in the following description is formed in a portion (a rubber adhesion portion) 1*b* in a surface 1*a* of the metal ring 1 to which a rubber 3 is adhered.

As shown in FIG. 2A, the metal ring 1 with a surface roughness 1*c* being formed in the rubber adhesion portion 1*b* is next exposed to an adhesion treatment, or a zinc phosphate treatment or a shot blast treatment and an adhesion treatment, as shown in FIG. 2B, whereby an adhesive agent film 2 is formed on a surface 1*a* thereof, and then, as shown in FIG. 2C, a rubber 3 is formed thereon. In the case that the product is a sealing apparatus, the rubber 3 constitutes a rubber seal portion such as a seal lip, a seal packing or the like.

Figure 3:
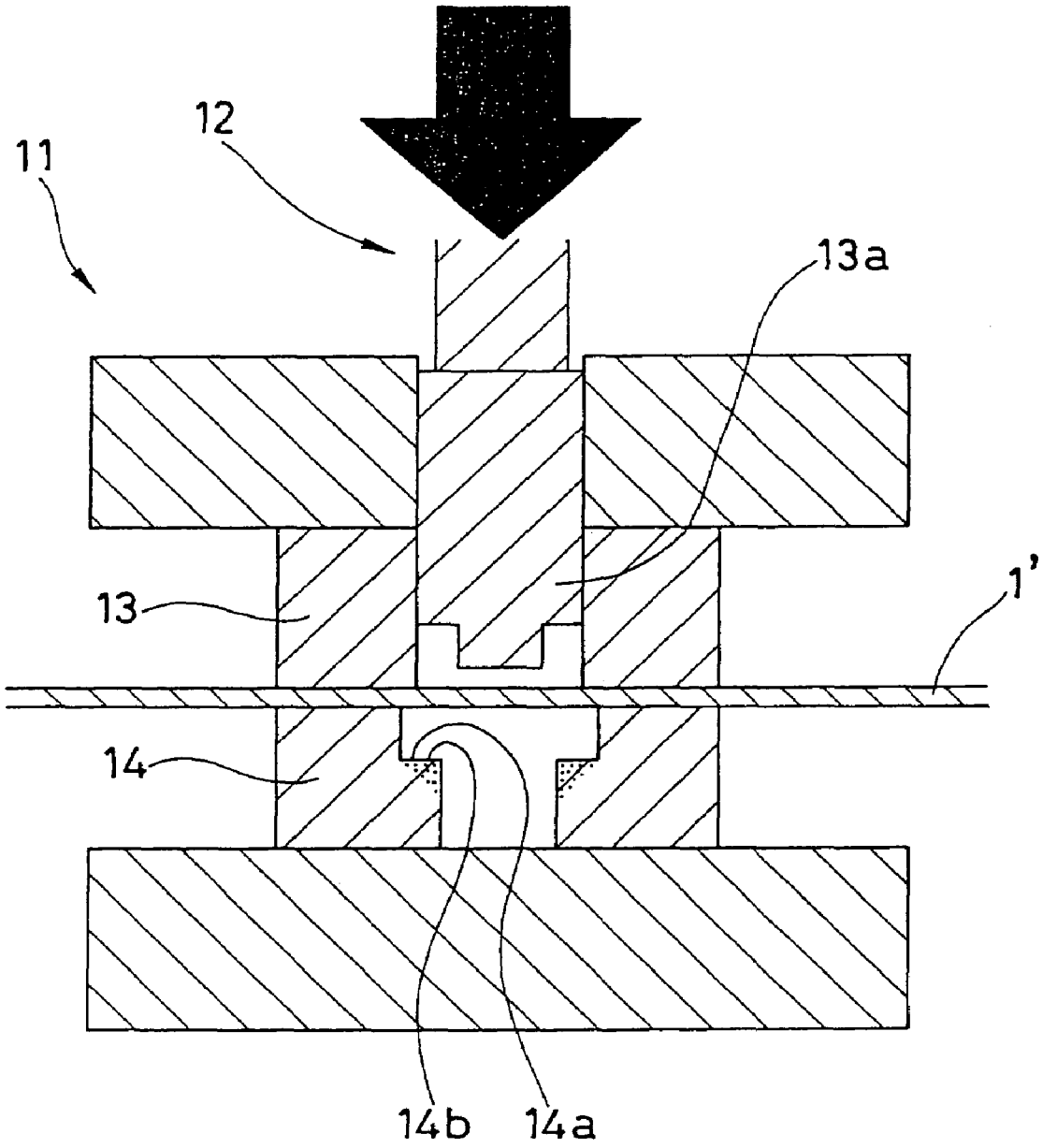
FIG. 3 is a schematic view of a manufacturing apparatus of the metal part.

Further, a manufacturing apparatus 11 for manufacturing the metal ring 1 is provided, as shown in FIG. 3, for example, with a press portion 12 for punching and pressing a rolled steel 1' corresponding to the raw material, and molds (also called as press molds) 13 and 14 placed in this press portion 12 and transcribing a shape and a size thereof into the rolled steel 1', and a surface roughness 14*b* for transcription is previously provided in a portion (also called as a roughness applying portion or a roughness transcribing portion) 14*a* corresponding to a roughness application portion of the metal ring 1 in the lower mold 14 among the molds 13 and 14.

At a time of manufacturing the metal ring 1, as shown in FIG. 3, the metal ring 1 is formed by punching and pressing the rolled steel 1' held and fixed between the upper mold 13 and the lower mold 14 by an upper mold movable portion 13*a*. In this step of forming metal ring 1, the surface roughness 14*b* for transcription previously provided in the roughness applying portion 14*a* of the lower mold 14 is transcribed into the rubber adhesion portion 1*b* in the metal ring 1 by a pressing force, whereby the surface roughness 1*c* is formed in the rubber adhesion portion 1*b* of the metal ring 1.

It has been experimentally confirmed that a correlation between a magnitude Rz of the surface roughness 1*c* formed in the rubber adhesion portion 1*b* of the metal ring 1 and the adhesive strength improving effect in the items 1 to 3 mentioned above is substantially as follows.

① In the case that Rz=~5 μm (less than 5 μm)

The level of surface roughness is same as the conventional preliminary treatment, and no specific effect is obtained.

② In the case that Rz=5~10 μm (5 μm or more and less than 10 μm)

A slight improving effect can be found, however, no sufficient effect can be obtained.

③ In the case that Rz=10~60 μm (10 μm or more and less than 60 μm)

A sufficient effect can be obtained.

④ In the case that Rz=60 μm~(60 μm or more)

A sufficient effect can be obtained, however, the reduction of strength in the metal ring 1 becomes questionable.

In this case, taking the transcription done by an output of the press into consideration, Rz=10~40 μm (10 μm or more and 40 μm or less) for an optimum surface roughness.

Further, the surface roughness 1*c* formed in the metal ring 1 is not provided by directly working the metal ring 1 but done by providing a certain surface roughness 14*b* in a portion 14*a* corresponding to the surface roughness 1*c* formed on the surface of the metal ring 1 in the press molds 13 and 14 at a time of pressing so as to transcribe the roughness into the metal ring 1. In this case, a level of the surface roughness 14*b* of the roughness applying portion 14*a* in the metal mold 14 required for obtaining the surface roughness 1*c* of the metal ring 1 capable of obtaining a sufficient effect is different depending on a working condition, a material of the mold and the rolled steel and the like, and, can not be completely defined. However, in this embodiment, since a press surface pressure in a general cold rolled steel is about 60 kgf/mm$^2$ and a transcription rate of mold roughness is 50~60%, a level of the surface roughness 14*b* formed in the roughness applying portion 14*a* in the lower mold 14 is 20~80 μm (20 μm or more and 80 μm or less). In this case, the transcription rate of the surface roughness has a correlation with the press surface pressure, the material hardness and the like.

Further, the working method of the roughness applying portion 14*a* in the lower mold 14 can employ a lot of working methods such as electric discharge machining, grinding, shot-blasting or the like, however, when a specific portion of the mold 14 is particularly complex like as this embodiment, the electric discharge machining is useful.

Further, in general, in the case of working by an NC electric discharge machine, the roughness is controlled by an electric discharge time, a distance between an electrode and a work, an electric voltage, an electrode oscillation and the like, however, if the material of the work and a target roughness are determined, the conditions mentioned above are accordingly determined.

As mentioned above, principles of improvement of adhesive strength generated by forming the surface roughness 1*c* in accordance with the present invention are the following three points.

① An effect of increasing a surface area or an adhesive area

In general, an adhesive force between the adhesive agent and the rubber is in proportion to the adhesive agent strength and the adhesive area, and the adhesive area is in proportion to the metal surface roughness because the adhesive area becomes substantially equivalent to the metal surface area. Accordingly, since the adhesive area is increased together with the increase of the surface roughness, the adhesive force is increased.

② An effect of increasing an anchor generated by an increase of surface irregularity Both elements are physically adhered to each other in accordance that the adhesive agent enters into the recess portions of the metal surface, and, since the larger the roughness becomes, the larger the magnitude and the number of the recess portions are, the anchor effect is increased.

③ An effect of preventing an adhesive agent from flowing out generated by an increase of adhesive agent flow resistance When the metal surface roughness is increased, the flow resistance of the adhesive agent (liquid) is increased, so that it is possible to prevent the adhesive agent from flowing out.

Accordingly, on the basis of these principles, it is possible to improve an adhesive property between the metal part 1 and the rubber 3 given by the adhesive agent, and since the structure is made such that the surface roughness 1*c* is transcribed into the rubber forming portion 1*b* of the metal part 1 by previously providing with the surface roughness 14*b* in the corresponding portion 14*a* in the press mold 14 and pressing, it is possible to make it easy to form the surface roughness 1*c* only in the specific portion of the metal part 1 and it is possible to achieve an improvement of working accuracy in the surface roughness 1*c*, an improvement of maintenance property in the press mold 14, a reduction of working cost, a reduction of man hour and the like.

In this case, when the structure is made such that the surface roughness is transcribed into the metal part 1 from the mold 14, there the following problems may occur.

① Depending on a shape of the mold 14 or a magnitudes of the pressurizing force at a time of working, there is an article in which the surface roughness is not sufficiently transcribed into the metal part 1 from the mold 14 due to lack of contact surface pressure at a time of working.

② In view of a clearance of the material (the metal material) in the metal part 1, in an article in which the contact area between the roughness applying portion 14*a* of the mold 14 and the metal part 1 is large, there is a case that a dispersion is generated in the transcribed surface roughness. For example, in the metal ring 1 in the embodiment mentioned above, a dispersion occurs in a diametrical direction in the transcribed portion, so that a rate of transcription is high in an end portion in the diametrical direction, and the rate of transcription becomes low in a center portion in the diametrical direction.

In order to solve the problems mentioned above, it is preferable that recess portions such as grooves deeper than the surface roughness or the like are additionally provided in a roughness applying portion of the mold in which the surface roughness is previously provided, as described in the fifth aspect mentioned above. When the recess portions such as the grooves or the like are provided in the roughness applying portion in the mold in addition to the surface roughness as mentioned above, it is possible to increase the contact surface pressure at a time of working because the contact area is reduced. Further, it is possible to secure the clearance for the material of the metal part, whereby it is possible to improve the rate of transcription into the metal part from the mold.

Embodiments of the recess portion are as follows.

Figure 4:
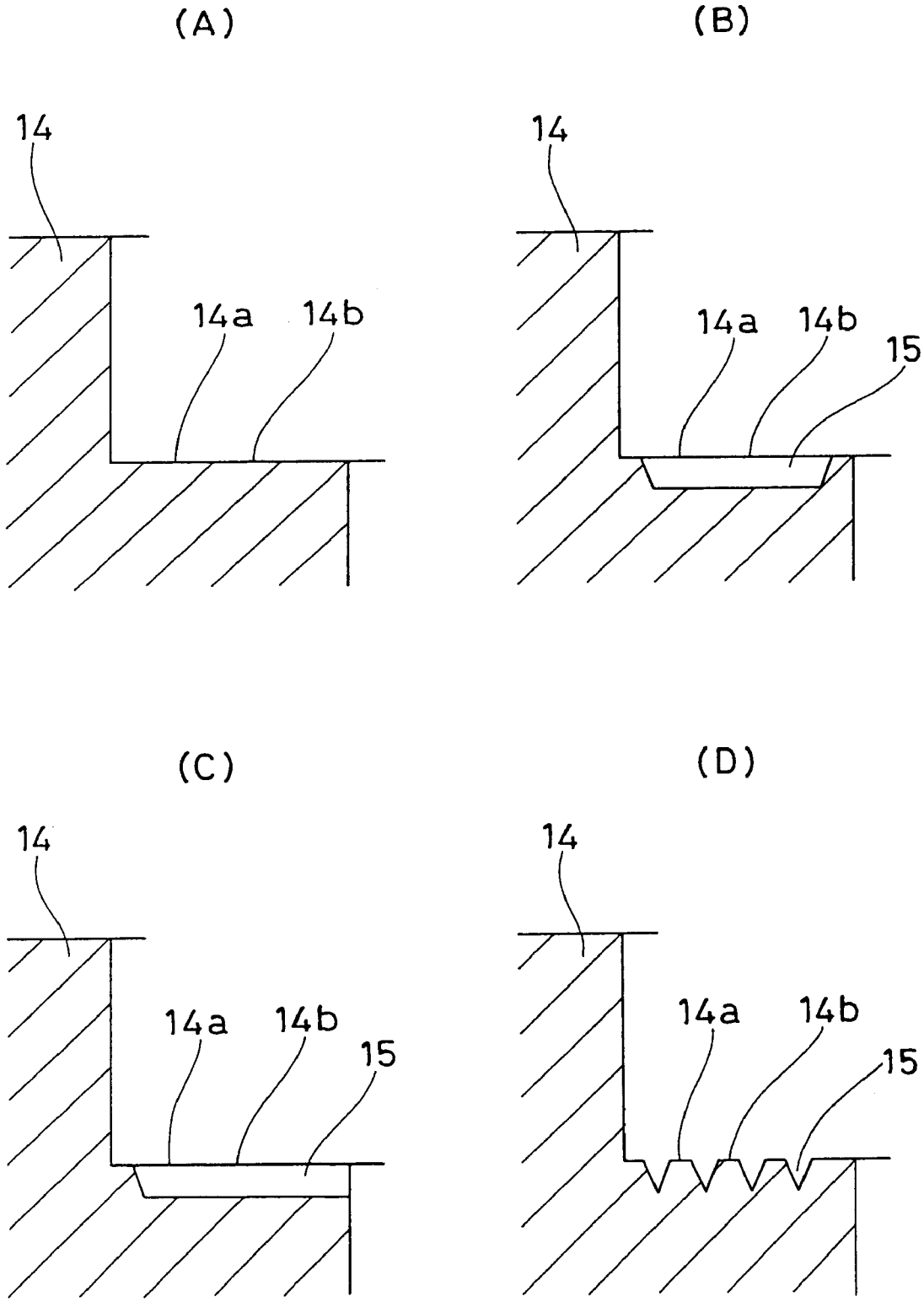
FIGS. 4A, 4B, 4C and 4D are enlarged cross sectional views of a roughness application portion in a mold.

That is, in addition to the surface roughness 14*b* provided in the roughness applying portion 14*a* in the press mold 14 for press working the metal ring 1 as shown in FIG. 4A, radial grooves 15 are provided in the roughness application portion 14*a* about that time so as to form the recess portion as shown in FIGS. 4B and 4C, or concentric grooves 15 are provided therein as shown in FIG. 4D. The grooves 15 in FIG. 4B are formed so as to run up to the inner peripheral edge portion of the roughness applying portion 14*a*, and on the other hand, the grooves 15 in FIG. 4C are formed so as not to run up to the inner peripheral edge portion of the roughness applying portion 14*a*.

In any cases, when the surface roughness 14*b* is provided in the roughness applying portion 14*a* of the press mold 14 and the radial or concentric grooves 15 are provided therein in the manner mentioned above, the following operations and effects can be obtained.

① Since the area of the roughness applying portion 14*a* is reduced correspondingly to the groove area and the contact surface pressure at a time of pressing is increased, it is possible to improve the rate of roughness transcription.

② Since the material of the metal ring 1 in both sides of the grooves 15 flows into the grooves 15 at a time of pressing, and the pattern of the press mold 14 can be easily transcribed, a difference in the rate of transcription between the end portion in the diametrical direction and the center portion in the diametrical direction is reduced. Accordingly, it is possible to uniformly transcribe the surface roughness.

SECOND EMBODIMENT

Figure 5:
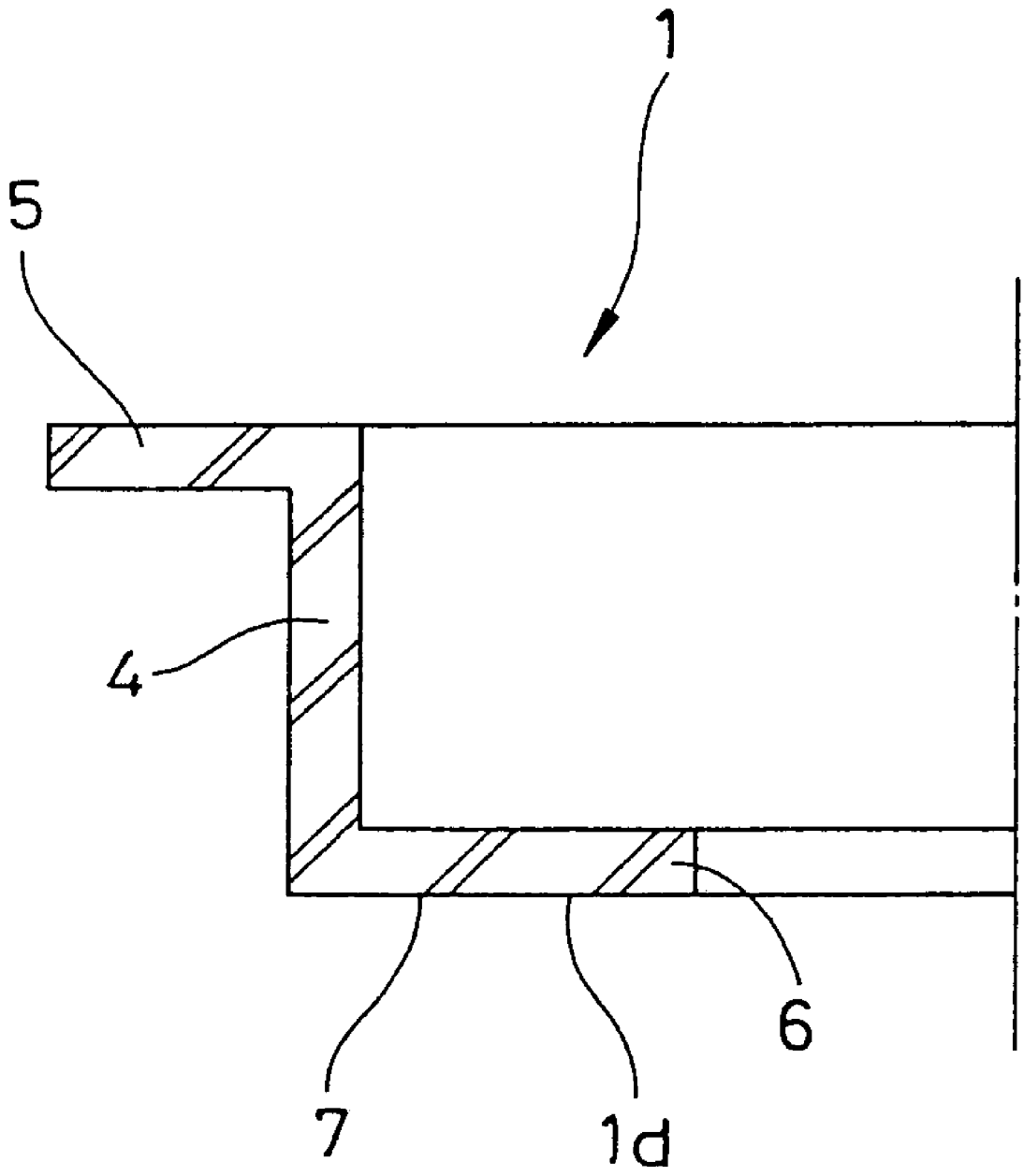
FIG. 5 is an outlined half cut cross sectional view of a metal part in accordance with a second embodiment of the present invention.

FIG. 5 shows a half cut cross section of a metal ring 1 corresponding to a metal part in accordance with a second embodiment of the present invention. A surface roughness 7 is formed in a contact surface 1*d* corresponding to a portion of a surface of the metal ring 1. An illustrated metal ring 1 is structured such that an outward flange-like collar portion 5 is provided in one end in an axial direction of a tubular portion 4 and an inward flange-like collar portion 6 is provided in another end in an axial direction of the tubular portion 4. Since an end surface of the latter inward flange-like collar portion 6 is considered as a contact surface 1*d* which possibly contacts with another metal ring (not shown) to be bonded, the surface roughness 7 is provided in the contact surface 1*d*.

Figure 6:
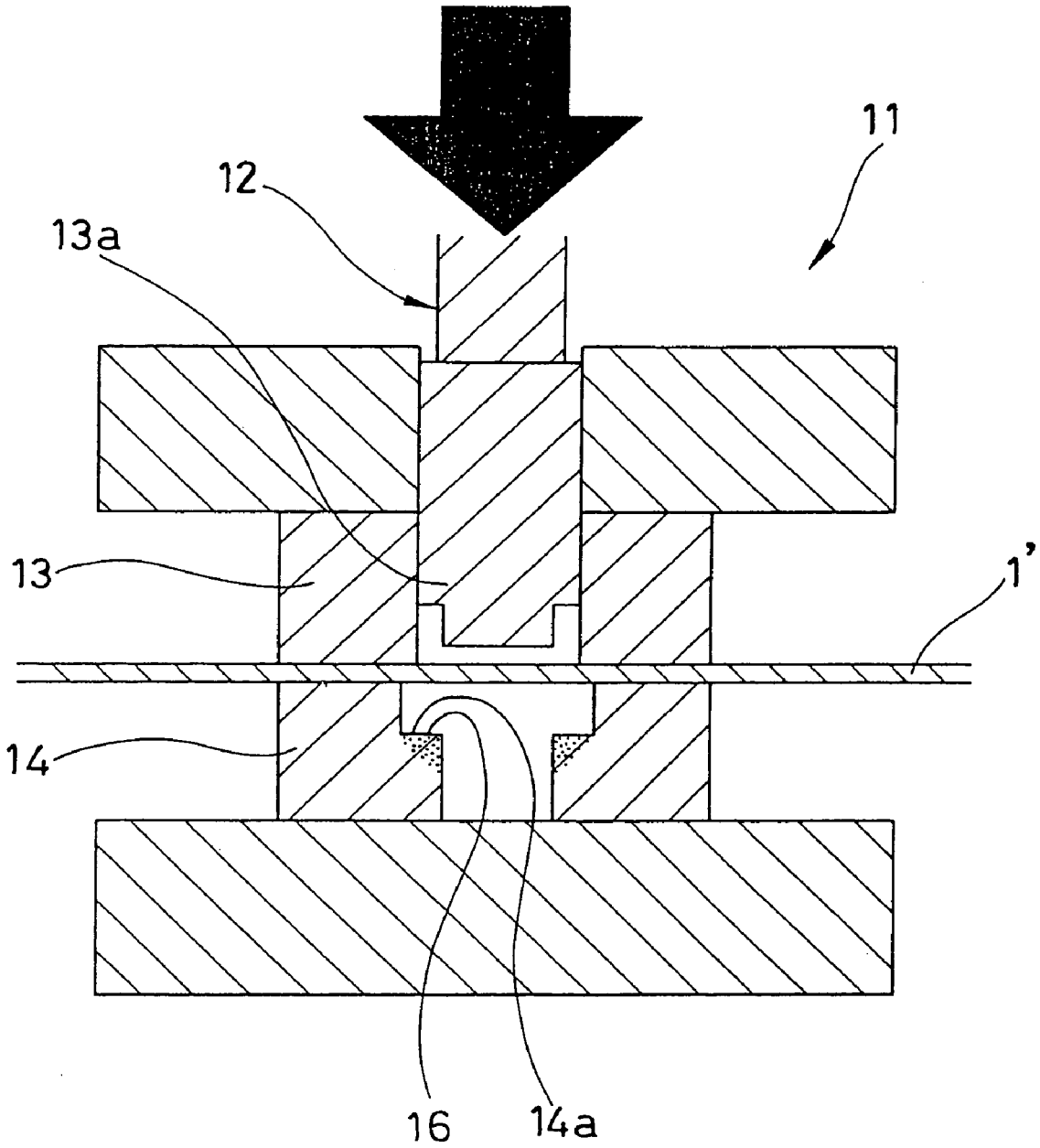
FIG. 6 is a schematic view of a manufacturing apparatus for manufacturing the metal part.

The metal ring 1 is formed, as shown in FIG. 6, by punching and pressing a rolled steel 1' corresponding to the raw material, and a manufacturing apparatus 11 thereof is, for example, structured as follows.

That is, at first, there is provided with a press portion 12 for punching and pressing the rolled steel 1' corresponding to the raw material, and a pair of upper and lower molds (which is constituted by an upper mold and a lower mold, and is also called as press molds) 13 and 14 for transcribing a pattern and a size thereof into the rolled steel 1' are provided in this press portion 12, and a surface roughness 16 for transcription is previously provided in a portion (which is also called as a roughness applying portion or a roughness transcribing portion) 14*a* corresponding to the contact surface 1*d* of the metal ring 1 in the lower mold 14 among the molds 13 and 14.

At a time of operating the apparatus 11 to manufacture the metal ring 1, as shown in FIG. 6, the metal ring 1 is formed by punching and pressing the rolled steel 1' held and fixed between a pair of molds 13 and 14 by an upper mold movable portion 13*a*. When the metal ring 1 is formed in the manner mentioned above, the surface roughness 16 for transcription previously provided in the roughness applying portion 14*a* of the mold 14 is transcribed into the contact surface 1*d* in the metal ring 1 by a pressing force, whereby the surface roughness 7 is formed in the contact surface 1*d* of the metal ring 1.

It has been experimentally confirmed that a correlation between a magnitude (level) Rz of the surface roughness 7 formed in the contact surface 1*d* of the metal ring 1 and the bonding prevention effect is substantially as follows.

① In the case that Rz=~5 μm (less than 5 μm)

The level of surface roughness is same as the conventional general preliminary treatment is obtained, and non-specific effect.

② In the case that Rz=5~10 μm (5 μm or more and less than 10 μm)

A slight improving effect can be founds however, no sufficient effect can be obtained.

③ In the case that Rz=10~60 μm (1 μm or more and less than 60 μm)

A sufficient effect can be obtained.

④ In the case that Rz=60 μm~(60 μm or more)

A sufficient effect can be obtained, however, the reduction of strength in the metal ring 1 becomes questionable.

In this case, taking the transcription done by an output of the press into consideration, Rz=10~40 μm (10 μm or more and 40 μm or less) for an optimum surface roughness.

Further, the surface roughness 7 formed in the metal ring 1 is not provided by directly working the metal ring 1 but done by providing a certain surface roughness 16 in a portion 14*a* corresponding to the surface roughness 7 formed on the surface of the metal ring 1 in the press molds 13 and 14 at a time of pressing so as to transcribe the surface roughness into the metal ring 1. In this case, a level of the surface roughness 16 of the roughness applying portion 14*a* in the lower mold 14 required for obtaining the surface roughness 7 of the metal ring 1 capable of obtaining a sufficient effect is different depending on a working condition, a material of the mold and the rolled steel, and the like, and can not be completely defined. However, in this embodiment, since a press surface pressure in a general cold rolled steel is about 60 kgf/mm$^2$ and a transcription rate of mold roughness is 50~60%, a level of the surface roughness 16 formed in the roughness applying portion 14*a* in the lower mold 14 is 20~80 μm (20 μm or more and 80 μm or less). In this case, the transcription rate of the surface roughness has a correlation with the press surface pressure, the material hardness, and the like.

Further, the working method of the roughness applying portion 14*a* in the lower mold 14 can employ a lot of working methods such as an electric discharge machining, grinding, shot-blasting or the like, however, when a specific portion of the mold 14 is particularly complex like as this embodiment, the electric discharge machining is useful. Further, in general, in the case of working by an NC electric discharge machine, the roughness is controlled by an electric discharge time, a distance between an electrode and a work, an electric voltage, an electrode oscillation, and the like, however, if the material of the work and a target roughness are determined, the conditions mentioned above are accordingly determined.

Figure 7:
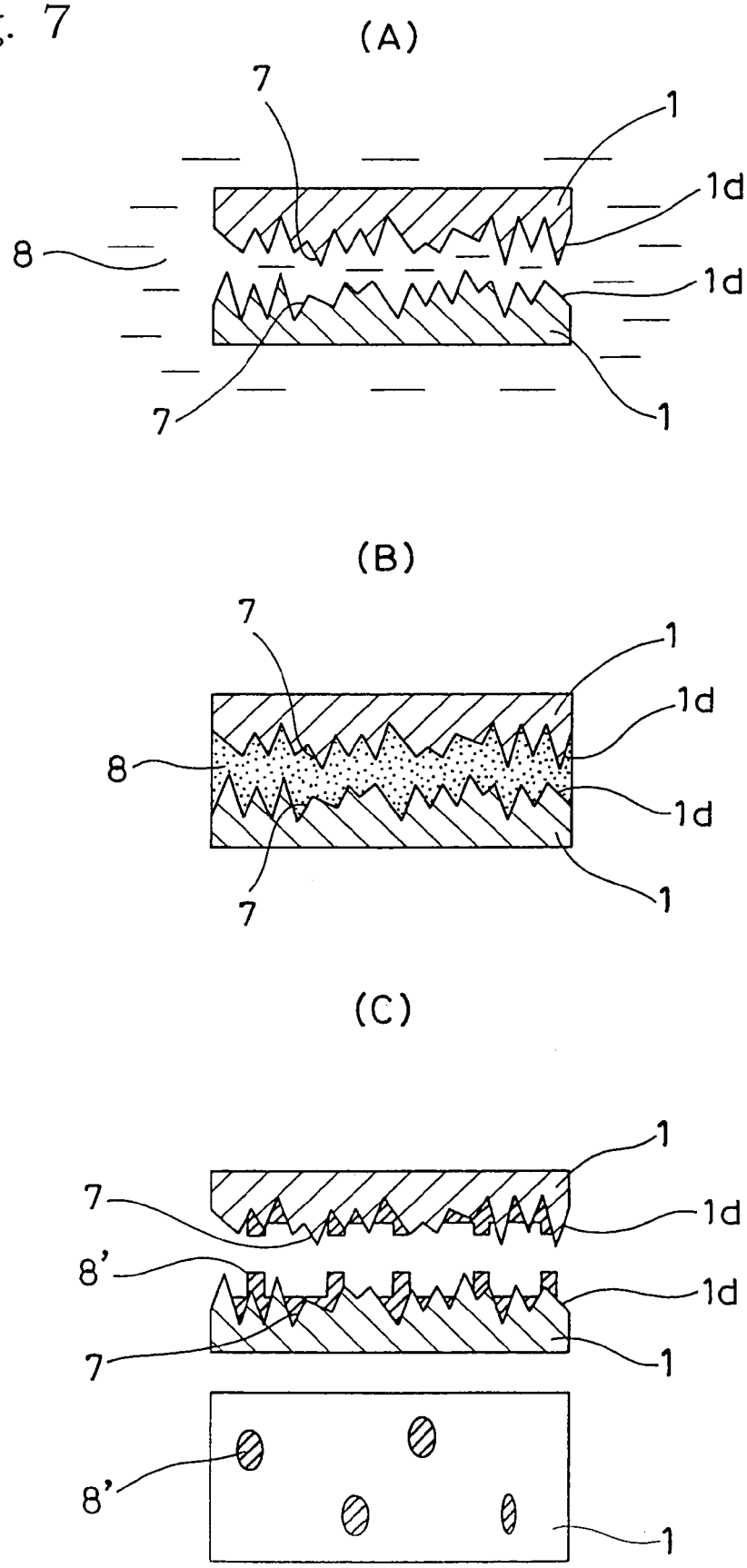
FIGS. 7A, 7B and 7C are schematic views showing an bonding preventing principle in accordance with the present invention in this order.
Figure 8:
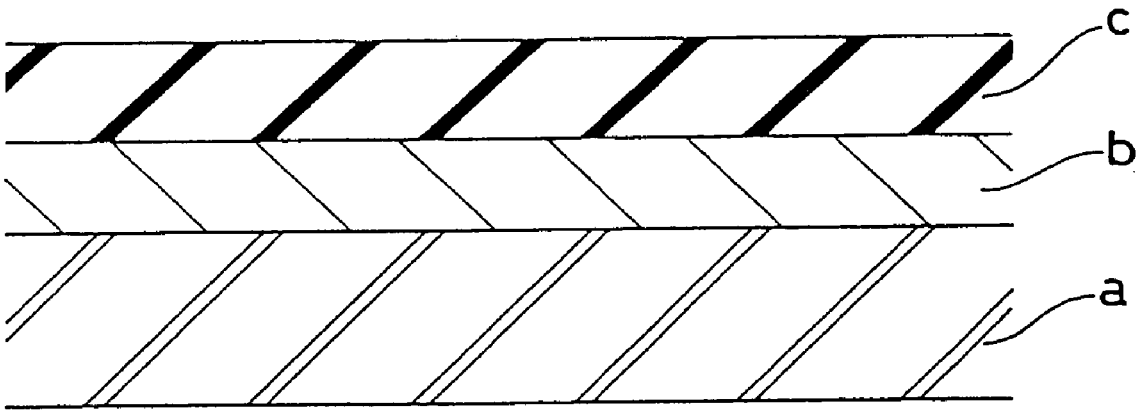
FIG. 8 is a schematic view showing a laminated structure among a metal part, an adhesive layer and a rubber.
Figure 9:
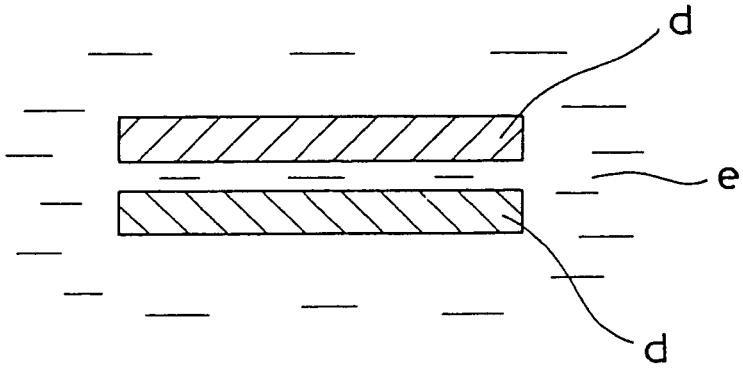
FIGS. 9A, 9B and 9C are schematic views showing an bonding occurring principle in accordance with the conventional art in this order.
Figure 9:
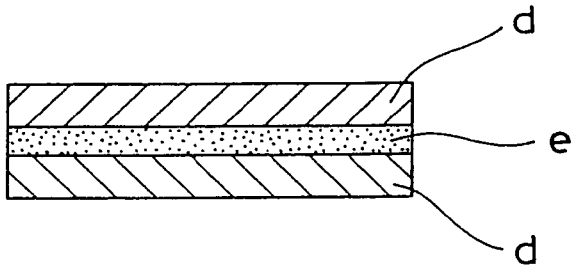
Figure 9:
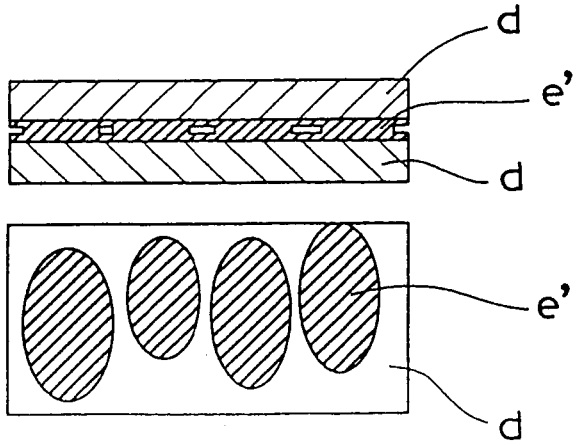

As mentioned above, a principle of bonding prevention obtained by adding the surface roughness 7 to the metal ring 1 is to reduce the adhesive agent application area between the metal rings 1 after drying and sintering and reduce the bonding force in proportion to the adhesive agent application area, thereby preventing the bonding (refer to FIG. 7).

Accordingly, in the case of simultaneously dipping a plurality of metal rings 1 in the adhesive agent solution 8 and applying the adhesive agent solution 8 to the surfaces of the respective metal rings 1, it is possible to prevent an bonding failure in which the metal rings 1 are bonded to each other via the adhesive agent 8', on the basis of the principle mentioned above, and it is possible to omit a "disassembling step" in the prior art mentioned above, and even in the case that the "disassembling step" is carried out, it is possible to reduce a magnitude of applied impact.

Further, since the structure is made such that the surface roughness 16 is transcribed into the contact surface 1*d* of the metal part 1 from the mold 14 by previously providing with the surface roughness 16 in the corresponding portion 14*a* in the mold 14 for working the metal ring 1, it is possible to make it easy to form the surface roughness 7 in the specific portion 1*d* of the metal ring 1 and it is possible to achieve an improvement of working accuracy in the surface roughness 7, an improvement of maintenance property in the mold 14, a reduction of working cost, a reduction of man hour, and the like.

In this case, when the structure is made such that the surface roughness is transcribed into the metal ring 1 from the mold 14, the following problems may occur.

① Depending on a shape of the mold 14 or a magnitude of the pressurizing force at a time of working, there is an article in which the surface roughness is not sufficiently transcribed into the metal ring 1 from the mold 14 due to lack of contact surface pressure at a time of working.

② In view of a clearance of the material (the metal material) in the metal ring 1, in an article in which the contact area between the roughness applying portion 14*a* of the mold 14 and the metal ring 1 is large, there is a case that a dispersion occurs in the transcribed surface roughness. For example, in the metal ring 1 in the embodiment mentioned above, a dispersion is generated in a diametrical direction in the contact surface 1*d*, so that a rate of transcription is high in an end portion in the diametrical direction, and the rate of transcription becomes low in a center portion in the diametrical direction.

In order to solve the problems mentioned above, it is preferable that recess portions (not shown) such as grooves deeper than the surface roughness 16 or the like are additionally provided in a roughness applying portion 14*a* of the mold 14 in which the surface roughness 16 is previously provided. When the recess portions such as the grooves or the like are provided in the roughness application portion 14*a* in the mold 14 in addition to the surface roughness 16 as mentioned above, it is possible to increase the contact surface pressure at a time of working because the contact area is reduced. Further, it is possible to secure the clearance for the material of the metal ring 1, whereby it is possible to improve the rate of roughness transcription into the metal ring 1 from the mold 14.

EFFECT OF THE INVENTION AND INDUSTRIAL APPLICABILITY

The present invention obtains the following effects.

That is, at first, in the invention in accordance with the first aspect to the sixth aspect of the present invention provided with the structure mentioned above, since it is possible to achieve the effect of increasing of the surface area or the adhesive area, the increase of the anchor effect caused by the increase of the surface irregularity and the effect of preventing the adhesive agent from flowing out generated by the increase of the adhesive agent flow resistance, in the portion (the rubber forming portion) in which the surface roughness is formed on the metal part, at a time of swishing off and drying after dipping the metal part into the adhesive agent tank, whereby the sufficient adhesive agent film is formed, it is possible to obtain the good adhesive force, so that it is possible to improve the adhesive property between the metal part and the rubber.

Further, since the structure is made such that the surface roughness is transcribed into the rubber forming portion in the metal part by previously providing the surface roughness in the corresponding portion in the mold to work the metal part, it is possible to make it easy to form the surface roughness in the specific portion in the metal part, and it is possible to achieve the improvement of working accuracy in the surface roughness, the improvement of mold maintenance property, the reduction of working cost, the reduction of man hour, and the like.

Further, in the invention in accordance with the seventh aspect of the present invention provided with the structure mentioned above, since the contact area between the roughness applying portion in the mold and the metal part is reduced, it is possible to increase the contact surface pressure at a time of pressurizing and it is possible to secure the clearance for the metal material, so that it is possible to improve the rate of transcribing the roughness into the metal part from the mold.

Further, on the basis of the invention in accordance with the eighth aspect to the thirteenth aspect of the present invention provided with the structure mentioned above, in common with each of the aspects mentioned above, at first, by forming the surface roughness in the contact surface of the metal part, it is possible to reduce the contact area of the adhesive agent after the adhesion treatment and it is possible to reduce the bonding force due to the adhesive agent, whereby it is possible to prevent the bonding failure in which the metal parts are bonded to each other via the adhesive agent from occurring.

Further, since the structure is made such that the surface roughness is transcribed into the contact surface of the metal part from the mold by previously providing the surface roughness in the corresponding portion in the mold for working the metal part, it is possible to make it easy to form the surface roughness in the specific portion of the metal part, and it is possible to achieve the improvement of working accuracy in the surface roughness, the improvement of mold maintenance property, the reduction of working cost, the reduction of man hour, and the like.

What is claimed is:

1. An oil seal comprising:

a metal ring member;

a rubber seal lip portion adhered to the metal member via an adhesive agent;

a surface roughness of said metal ring member being limited to only a portion of a surface of said metal ring member for increasing an adhesive property between the metal ring member and the rubber seal lip portion, a magnitude of the surface roughness formed on the portion of the surface of the metal ring member being 10 μm or more and less than 60 μm, the rubber seal lip portion being adhered only to the portion of the surface of the metal ring member including said surface roughness.

2. The oil seal as claimed in claim 1, wherein a magnitude of the surface roughness Rz formed on the portion of the surface of the metal ring member is 10 μm or more and 40 μm or less.

* * * * *